United States Patent [19]

Poehler

[11] 4,454,980

[45] Jun. 19, 1984

[54] RETURN BILLER ENVELOPE BOOK

[76] Inventor: Oliver Poehler, 920 W. Elm, Wheaton, Ill. 60187

[21] Appl. No.: 327,609

[22] Filed: Dec. 4, 1981

[51] Int. Cl.[3] ..... B65D 27/10

[52] U.S. Cl. ..... 229/69; 229/73; 493/216; 493/921

[58] Field of Search ..... 229/69, 73; 493/216, 493/921; 282/22 R, 25

[56] References Cited

U.S. PATENT DOCUMENTS

| | | | |
|---|---|---|---|
| 791,362 | 5/1905 | Parmenter | 229/69 |
| 2,201,538 | 5/1940 | Holden | 229/73 |
| 2,332,638 | 10/1943 | Heywood | 229/69 |
| 2,783,935 | 3/1957 | Mercur | 229/69 |
| 2,824,686 | 2/1958 | Hamilton | 229/69 |
| 3,261,623 | 7/1966 | Kredrowski | 229/69 |
| 3,980,006 | 9/1976 | Welch | 229/69 |
| 4,091,987 | 5/1978 | Cone | 229/69 |

FOREIGN PATENT DOCUMENTS

| | | | |
|---|---|---|---|
| 984917 | 3/1965 | United Kingdom | 229/69 |

*Primary Examiner*—Stephen P. Garbe
*Attorney, Agent, or Firm*—Edmond T. Patnaude

[57] ABSTRACT

A number of bill paying envelopes for use in making periodic payments are removably affixed to a continuous prefolded web which carries the envelopes through a computer controlled printer wherein confidential account information is printed on the inside surface of the envelope flap, the web being subsequently folded to provide a flat booklet of said envelopes.

7 Claims, 4 Drawing Figures

RETURN BILLER ENVELOPE BOOK

The present invention relates in general to bill paying systems wherein the customer is provided with a number of pre-addressed envelopes for use in making periodic payments, and it relates in particular to a system wherein the envelopes are removable affixed to a single, foldable web which carries the envelopes through a computer controlled printer and is thereafter used to hold the envelopes together in the form of a book.

BACKGROUND OF THE INVENTION

In order to facilitate the collection of periodic bill payments it has been a common practice to provide the customer with a number of pre-addressed envelopes and an equal number of account identification sheets or coupons to be placed in the envelopes together with the payments. These systems are relatively costly to produce, and in many cases the customers have neglected to return the identification sheets with the payments.

It would be desirable to provide a system wherein the customer is provided with a book of pre-addressed envelopes each preprinted with the account and payment information so that use of the envelopes automatically identifies the account to which the payment is to be credited. Moreover, such a system should be compatible with computer controlled printers to enable the custom printing of the account information on the envelops and to permit automatic crediting of the payments when received.

SUMMARY OF THE INVENTION

Briefly, there is provided in accordance with the present invention a billing system and return biller wherein preprinted envelopes carrying the address of the institution to which payments are to be made as well as other messages and/or advertising are removably affixed to a carrier web having the usual pin drive holes along the longitudinal edges for carrying the envelopes through a line printer or other computer controlled printer. The envelopes are oriented on the carrier web with the inside faces of the flaps and the rear faces of the envelopes exposed. Information in the form of messages, advertising, data identification boxes and the like may be preprinted on either or both of these exposed faces of the envelopes prior to affixing the envelopes to the carrier web. Similar information may also be preprinted on one or both sides of the carrier web. All of this preprinted information may be common to all accounts of the same type.

The institution issuing the return biller envelope book will ordinarily have a computer and computer controlled printer on its premises. The carrier web with the affixed envelopes is fed through that printer which prints on one or both of the exposed faces of the requisite number of envelopes the information pertaining to the particular account and payments for which the envelopes are to be issued. That length of carrier web corresponding to the number of payment envelopes included in the book is then torn off and the carrier web folded back and forth along transverse fold lines to provide a book of bill payment envelopes in which each envelope bears the corresponding account and payment information on the surface which is hidden from view when the envelope is used.

In another embodiment of the invention machine readable account information is printed on the bill payment envelopes to enable automatic entry of the payments upon receipt of same by the issuing institution.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 1:
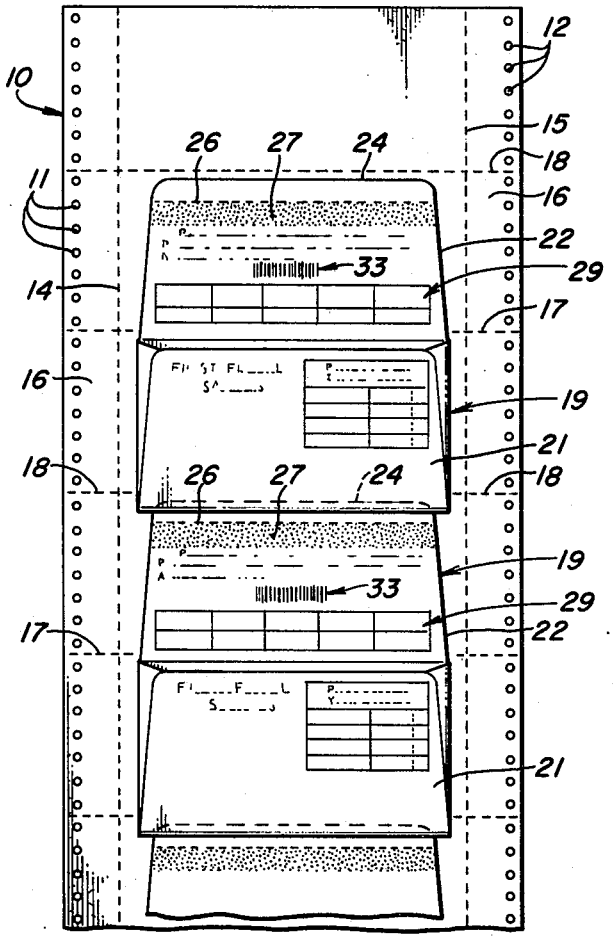
FIG. 1 is a plan view showing a plurality of bill payment envelopes affixed to a continuous carrier web which may be used for transporting the envelopes through a computer controlled line printer.

Referring to FIG. 1, there is shown a portion of a continuous carrier web 10 having two series of holes 11 and 12 respectively provided along the longitudinal edges of the web for receiving the pins of a sprocket or other drive system (not shown). The edge sections of the carrier which carry the pin drive holes 11 and 12 are connected to the central section of the carrier web by lines of weakness 14 and 15 to permit separation of a pair of longitudinal edge strips 16 from the carrier web following the final printing or other operation in which the pin drive holes are used. The carrier web 10 is also provided with a plurality of transversely extending fold lines 17 and 18 which facilitate subsequent folding of the carrier back and forth along these fold lines as described more fully hereinafter.

In accordacne with one aspect of the present invention a plurality of envelopes 19 are attached to the carrier web 10 with the rear face of the pocket portion 21 and the inner face of the flap portion 22 facing outwardly from the carrier web 10. The upper edges of the envelope flaps 22 are identified by the reference character 24, which edges, as shown in the drawing, are located a short distance below the adjacent fold line 18. The envelope flaps 22 may be attached to the carrier in any suitable manner which permits subsequent removal of the envelopes from the carrier web. In the preferred embodiment of the invention, however, the flaps are provided with a tear line 26 extending parallel to and located below the edge 24. Only the upper strip portion of the flap located between the tear line 26 and the edge 24 is affixed to the carrier web by means, for example, of a permanent adhesive. The portion of the exposed face of the envelope flap 22 below the tear line is coated with a band 27 of moisturizable glue for later use in sealing the flap to the envelope portion when the envelope is used to make a payment. Depending upon the size of the envelopes 19, the envelope portions 22 of the envelopes may, as shown, partially overlay the flap portions of the next adjacent envelopes without adversely affecting the operation of the system.

As noted above, prior to being attached to the carrier web the envelopes may be printed on both sides with any suitable information common to all of the envelopes. For example, the front faces of the envelope portions will ordinarily be preprinted with the address of the institution issuing the envelope book, and messages relating to the use of the envelopes may be preprinted on the rear faces of the envelopes. However, some areas on either the inside face of the flap or on the rear face of the envelope portion, or both, must be left open for receiving the computer controlled account and payment data to be printed thereon by the issuing institution. This latter information may be printed, for example, in the location 29 reserved for this purpose. Moreover, various types of information may be printed on the carrier web itself. For example, a message and/or a bill payment record for use by the payor may be preprinted on the portion of the carrier which will constitute the front face of the carrier in the return biller book of envelopes. One such format is shown in FIG. 2.

In accordance with another aspect of this invention, the issuing institution is provided with a quantity of carriers to which a large number, say five-thousand, preprinted bill paying envelopes have been affixed in the manner shown in FIG. 1. When a biller kit is to be made up for a particular account, the carrier web and associated envelopes are driven through a line printer or the like under the control of a computer to print the account number and other pertinent information, such as the amounts of the payments and the due dates, in the location 29 on a number of envelopes equal to the number of payments to be made within a desired period of time. The carrier is then torn or severed along the fold line 17 just above the last envelope in the set and a book 30 of envelopes is formed by simply lowering the carrier and attached envelopes onto a flat surface inasmuch as the carrier will automatically fold back and forth along the lines 17 and 18. The edge strips 16 are then torn off along the lines 14 and 15 to provide the completed book of envelopes shown in FIG. 2. One or more staples 32 may then be used to hold the booklet together. These staples must be postioned above the tear lines 26 on the flaps of the envelopes so as not to interfere with the later removal of the envelopes from the book.

Figure 2:
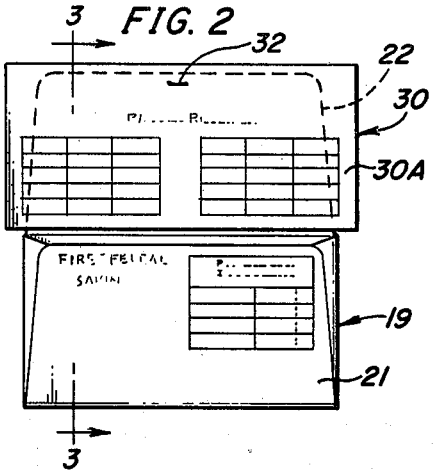
FIG. 2 is an elevational view of a return biller in the form of a booklet of bill payment envelopes.
Figure 3:
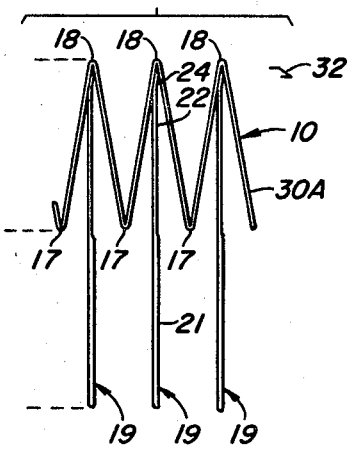
FIG. 3 is a cross-sectional view of the booklet of FIG. 2 taken along the line 3—3 of FIG. 2 with the booklet expanded to better illustrate its construction.

As shown in FIGS. 2 and 3, the book 30 comprises a plurality of envelopes 19 removably attached to the carrier 10, the latter being folded back and forth along the fold lines 17, 18 to provide an accordian-like carrier from which the envelopes can be selectively removed. Preferably the top face 30A of the carrier is printed with instructions for using the envelopes for making mortgage or other regular payments. In addition, the top face 30A may provide a personal payment record in which the amount and date of payment, check number and other information can be entered by the user as the bills are paid. Each envelope also includes the individual account and payment information which is hidden when the flap is folded over and sealed to the rear face of the envelope when the envelope is used.

When an envelope 19 containing a payment is received by the issuing institution, the flap is opened and the pertinent account date, i.e., account number and amount of payment is visible to the person opening the envelope. That person may then enter the amount of the payment in the books of the institution.

Figure 4:
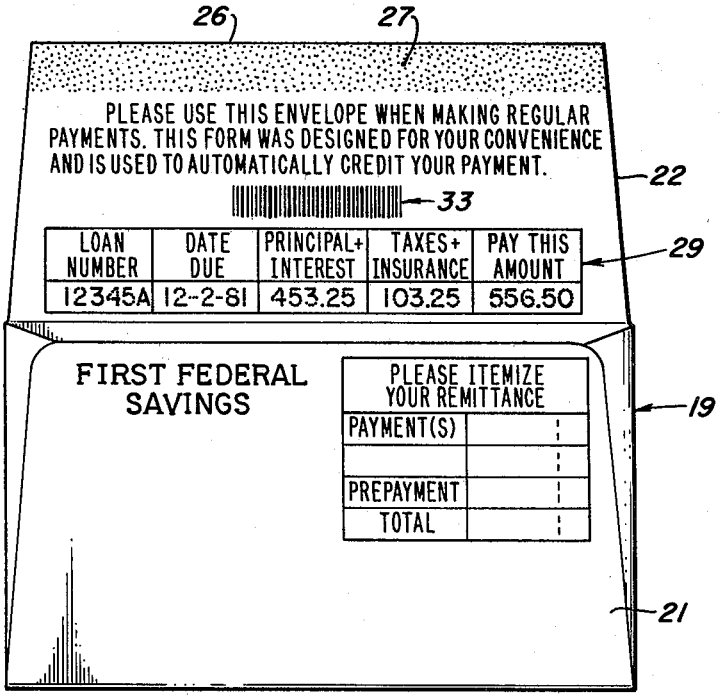
FIG. 4 is a view of the rear face of a mortgage payment envelope of one type usable in the system of the present invention.

When desired, machine sensible information may be printed on the rear faces of the open envelopes at the time they are imprinted with the account data by the issuing institution. As shown in FIG. 4, a horizontal band 33 containing a conventional optically readable bar code is located on the exposed face of the open flap 22. When this embodiment of the invention is used, the person opening the envelope for the payee first checks to see if the payment matches the amount shown on the envelope to be due, and if so, then simply causes the wand of an optical reader to pass across the strip 33 to automatically credit the amount of the payment to the corresponding account. As in the case of the account information, the machine sensible information can be printed on the rear face of the pocket portion 21 rather than on the inside face of the flap if desired.

It may thus be seen that the system of the present invention provides a return biller which facilitates the making of periodic payments and the crediting of such payments to the corresponding accounts. The cost of manufacturing the return biller books is relatively inexpensive, and the account and payment data is maintained in confidence while the envelopes are transmitted from the payor to the payee.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A return biller, comprising a carrier web having transversely extending parallel fold lines spaced apart by a predetermined distance, a plurality of bill payment envelopes each having a pocket portion and a flap portion foldable along a fold line between said portions over the rear face of said pocket portion and sealable thereto, said flap portions of said envelopes lying flat against one face of said carrier web with repective ones of said flap portions being removably affixed to said carrier web between alternate ones only of said fold lines on said carrier web, with the inner face of said flap exposed, said pocket portions of said envelopes lying flat against said one face of said carrier web in non-overlapping relationship with the adjacent flap portions of the other envelopes with the front faces of said envelopes facing said carrier web, and said fold lines on said envelopes being parallel to said fold lines on said carrier web, and said carrier web being folded back and forth along said fold lines with the flap portions only of said envelopes sandwiched between adjacent faces of said carrier web.

2. A return biller according to claim 1 wherein the name and address of the intended receipient of said envelopes is printed on the front faces of said envelopes.

3. A return biller according to claim 1 wherein information relating to a particular account is printed on the inner faces of said flap portions.

4. A return biller according to claim 3 wherein information relating to a particular account is printed on the rear faces of said pocket portions.

5. A return biller according to claim 1 wherein the pocket portions of said envelopes are located externally of the folded over carrier web.

6. A method of making a return biller, comprising the steps of providing a plurality of pre-addressed envelopes each having a flap portion adapted to be folded over the rear face of a pocket portion, affixing a narrow band at the distal edges of said flaps to spaced locations on a carrier web with the inner faces of said flaps and the rear faces of said pocket portions facing away from said carrier web, passing said carrier web and said envelopes through a printer and printing particular account information on the exposed faces of said envelopes, and folding said carrier web back and forth over said envelopes to provide a book of bill payment envelopes respectively having said account information printed on a location thereof which is hidden from view when said flap portion is folded over the rear face of said pocket portion.

7. A method according to claim 6 comprising the step of printing information on said carrier web prior to said step of affixing said flap portions to said carrier web.

* * * * *